United States Patent [19]

Fennekels et al.

[11] 4,018,066

[45] Apr. 19, 1977

[54] MACHINE FOR PRINTING PILE FABRICS

[75] Inventors: Peter Fennekels, Kempen-Huls; Herbert Schütze, Grefrath, both of Germany

[73] Assignee: Girmes-Werke A.G., Grefrath, Germany

[22] Filed: Apr. 26, 1974

[21] Appl. No.: 464,464

[30] Foreign Application Priority Data

Apr. 28, 1973 Germany ..... 2321592

[52] U.S. Cl. ..... 68/5 D; 8/2.5 A; 28/74 P; 101/470; 156/209; 156/387; 68/200

[51] Int. Cl.[2] ..... D06P 7/00; D06B 1/10

[58] Field of Search ..... 101/27, 41, 470; 8/2.5 A; 68/5 C, 5 D, 200; 28/74 P; 156/209, 277, 387

[56] References Cited

UNITED STATES PATENTS

| | | | |
|---|---|---|---|
| 1,630,824 | 5/1927 | Boehner | 101/27 |
| 1,845,553 | 2/1932 | Partiot | 101/172 |
| 2,296,408 | 9/1942 | Todd | 156/220 X |
| 2,404,073 | 7/1946 | Karfiol et al. | 156/219 X |
| 2,477,300 | 7/1949 | Karfiol et al. | 154/47 |
| 2,501,495 | 3/1950 | Carroll et al. | 101/27 |
| 2,783,175 | 2/1957 | Smith et al. | 154/106 |
| 3,010,861 | 11/1961 | Reese | 156/199 |
| 3,454,413 | 7/1969 | Miller | 156/209 X |
| 3,507,729 | 4/1970 | Miller | 156/209 |
| 3,788,106 | 1/1974 | True | 101/470 |

FOREIGN PATENTS OR APPLICATIONS

| | | | |
|---|---|---|---|
| 558,306 | 6/1958 | Canada | 156/220 |
| 961,708 | 6/1964 | United Kingdom | 156/220 |

OTHER PUBLICATIONS

Textile Manufacture, pp. 30 & 32; Vacuum Printing on Carpet Tiles, vol. 100, Jan. 1973.

*Primary Examiner*—Clyde I. Coughenour
*Attorney, Agent, or Firm*—Donald D. Jeffery

[57] ABSTRACT

Pile fabrics with a pile containing thermoplastic fibers are thermoprinted with a pattern, the contact pressure between the pile fabric and the thermoprinting web in the heating zone being such that about 40 to 60% of the pile is compressed, and immediately afterwards relief-formed and/or surface formed while still hot with a pattern which bears a strict relationship to the thermoprinted pattern. A machine for carrying out this process comprises a thermoprinting unit with adjustable contact pressure and a relief-forming and/or surface forming patterning unit which functions in synchronism and coordination therewith.

4 Claims, 3 Drawing Figures

MACHINE FOR PRINTING PILE FABRICS

BACKGROUND OF THE INVENTION

This invention relates to a method of and a machine for printing pile fabrics with a pile containing thermoplastic fibres by thermoprinting. More particularly, the invention relates to a method of and a machine for thermoprinting in conjunction with a synchronously performed relief-forming and/or surface forming patterning of pile fabrics which are preferably intended for imitation animal skins and which have a pile containing or consisting entirely of thermoplastic fibres.

According to the invention, the textile pile fabrics, preferably in web form, are printed in accordance with the known principles of thermoprinting, although the invention is concerned with the particular application of thermoprinting to highly sensitive pile fabrics.

In the context of the invention, thermoprinting is a printing process in which dyes are transferred from a print consisting, for example, of paper to the article to be dyed by sublimation of the dyes under dry heat.

An object of the invention is to allow the printing of pressure-sensitive pile fabrics by the thermoprinting process and at the same time obtain a relief-formed and/or surface-formed pattern on the surface of the pile fabric.

THE INVENTION

The invention provides a method of printing pile fabrics, the pile containing thermoplastic fibres in which thermoprinting and relief-forming and/or surfaceforming patterning are carried out successively in synchronism and combination with one another. The process according to the invention comprises thermoprinting a pattern onto the pile fabric with a thermoprinting web in a heating zone in which the pile fabric is exposed to a contact pressure, adapted to the particular type of fabric, against the thermoprinting web such that about 40 to 60% of the pile is compressed and immediately afterwards relief-forming and/or surface-forming the pile fabric while still hot with a pattern which bears a strict relationship to the printed pattern.

To produce imitation animal skins, the pile fabric can be patterned by embossing, ironing, stenciling or any similar treatment.

The invention also provides a machine for printing pile fabrics, the pile containing thermoplastic fibres, comprising a thermoprinting unit with an adjustable contact pressure, followed immediately by a relief-forming and/or surface-forming patterning unit which functions synchronously and in coordination with the thermoprinting unit.

DISCUSSION OF THE INVENTION AND ITS PREFERRED EMBODIMENTS

The thermoprinting unit generally comprises a printed web which travels over a heating plate, being offwound from one roll and wound onto another roll and preferably travelling synchronously with the web of pile fabric to be printed. This printed web comes into contact with the outer ends of the fibres of the pile in the vicinity of the heating plate, the web of pile fabric being pressed under an adjustable contact pressure against that side of the printed web carrying the dyes, so that it is possible to transfer the dyes onto the pile fibres without producing any undesirable changes in the texture of the pile. The contact pressure is preferably adjusted by the provision, opposite the heating plate, of a guide surface which can be adjuted relative to the heating plate.

The guide surface is preferably adjusted relative to the heating plate by means of a screw threaded spindle which is arranged on the guide surface and which provides for precision adjustment. Thus, the thermoprinting unit can be individually adjusted to the particular fabric to be printed.

An embossing roller with a counter roller for example is provided as the relief-forming or surface-forming patterning unit. Another possible embodiment of the patterning unit comprises a stencil drum with a turbulence beam built into it. The patterning unit can also comprise pressure stamps cooperating with a fixed supporting surface. These patterning units each working in synchronism with the preceding thermoprinting unit produce a relief-forming and/or surface-forming pattern in the fabric pile which has already been prined with sublimated dyes. Since the fabric has already been heated during thermoprinting to the temperature range required for the relief-forming and/or surface-forming patterning treatment, it is thus possible to directly couple two finishing operations which can be synchronised and carried out one immediately after the other.

In this way, not only is it possible to transfer extremely fine prints of animal skins to the pile of pile fabrics, but it is also possible to produce a relief-like and/or surface-like pattern belonging to the particular colour with complete coordination between both patterns.

In cases where an embossing roller with a counter roller is used as the patterning unit, the embossing roller remains unheated and can be provided internally with a cooling system. The embossing roller can rotate with or without friction relative to the fabric to be embossed.

In the case of pile fabrics with a pile containing thermoplastic fibres, intended for the production of imitation animal skins, the application of thermoprinting in its known form would crush the pile fabric under the effect of the excessive contact pressure generated. This would not only spoil the appearance of the fabric, it would also prevent the sublimated dye from penetrating deeply into the pile, because the pile would change into a compact, shingle-like structure under the effect of the high contact pressure.

This difficulty is overcome by the precision-adjustable fine setting of the interval between the thermoprinting paper travelling over the heated plate on the one hand and the pile of the pile fabric to be printed on the other hand, for which provision is made in the machine according to the invention. The elastic pile can be compressed without any adverse effects to around 40 to 60% of its normal volume, in other words if the normal depth of the pile is about 12 mm for example, the pile can be reduced to between 5 and 6 mm in depth during printing. When this only moderately compressed pile comes into direct contact with the heated thermoprinting paper in the heating zone at a temperature of for example about 210° to 230° C, the transfer of colours to the fabric obtained by the sublimation of dispersion dyes is surprisingly better than that obtained in cases where the fabric is more heavily compressed, as is normally the case in thermoprinting, with the thermoprinting paper pressed correspondingly more heavily onto the fabric.

The fabrics differing widely in regard to density and depth of pile needed for the production of imitation animal skins from pile fabrics each require an individual, precision adjustment of the interval between the heating plate carrying the thermoprinting paper and the support over which the pile fabric travels in the vicinity of the thermoprinting unit. This precision adjustment of the plate interval and, hence, of the contact pressure is essential for the satisfactory thermoprinting of pile fabrics. On the other hand, it prevents excessive compression of the sensitive pile and, on the other hand, provides for satisfactory sublimation and diffusion of the dyes from the thermoprinting paper into the fibres of the pile.

Pile fabrics suitable for treatment by the process and with the machine according to the invention are pile fabrics produced by the known techniques of weaving, knitting, circular knitting, tufting, also the pile fabrics produced by the Malipol and Voltex techniques. The thermoplastic fibres present in the pile are preferably synthetic fibres, such as polyamides, acrylic fibres and their copolymers, polyesters, cellulose-2½ acetate and triacetate.

DESCRIPTION OF THE DRAWINGS

Embodiments of the most important parts of the machine according to the invention are diagrammatically illustrated by way of example in the accompanying drawings, in which.

Figure 1:
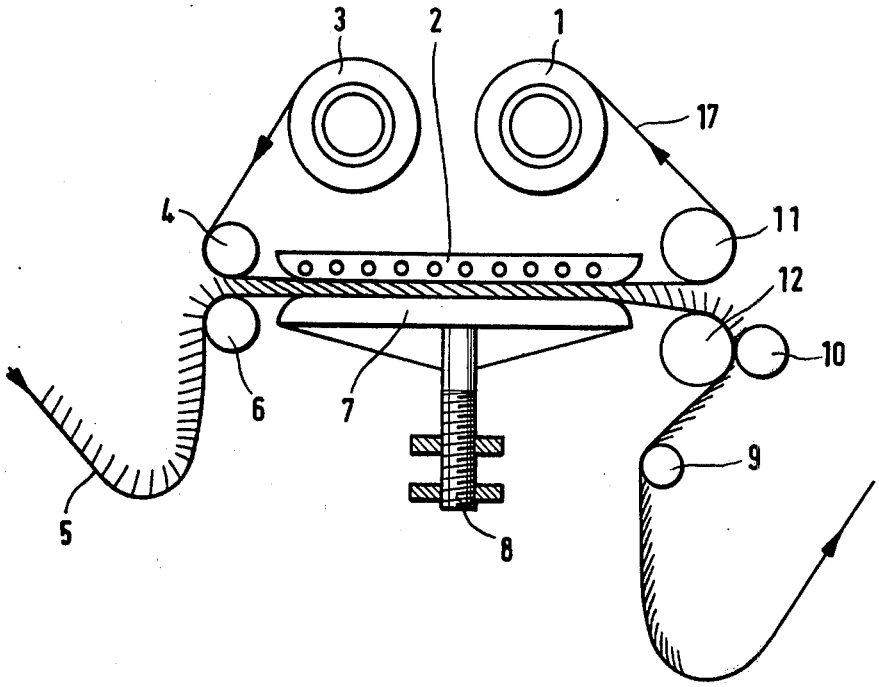
FIG. 1 is a side elevation, partly in section, of the thermoprinting unit and patterning unit of a machine according to one embodiment of the invention.

In the interests of clarity, only the thermoprinting unit and the following patterning unit have been diagrammatically illustrated in the drawings, although it is pointed out that, in all the illustrated embodiments of the invention, both units are accommodated in a common frame (not shown) so that the thermoprinting unit provided in every case and the following patterning unit are arranged at a fixed interval from one another and can be operated in synchronism with one another. A common main drive is preferably also provided for both units.

As shown in FIG. 1, a pile fabric 5 in web form is delivered by way of a brake roller 6 to a guide surface 7 which can be vertically adjusted by means of a screw threaded spindle 8 arranged underneath the guide surface 7. A fixed heating plate 2 over whose under surface travels a web 17 of thermoprinting paper, is arranged opposite the guide surface 7. The thermoprinting paper is offwound from a supply roll 3 and guided by means of a guide roller 4 onto the underneath of the heating plate 2. A take-off roller 11 ensures that the used thermoprinting paper is wound onto another roll 1.

The thermoprinting unit for printing the pile fabric 5 by sublimation of the dyes applied in layers to the thermoprinting paper consists essentially of the fixed heating plate 2 and of the guide surface 7 adjustable relative to the heating plate 2 by means of the screw threaded spindle S. By virtue of the fact that the interval between the heating plate 2 and the guide surface 7 can be pecision-adjusted, the pile fabric 5 travelling through between the heating plate 2 and the guide surface 7 can be compressed to around 40 to 60% of the particular thickness of its pile.

Immediately after the thermoprinting unit, through which the pile fabric 5 travels continuously at a speed of, for example, about 2 meters per minute, the pile of the pile fabric is embossed by means of an embossing roller 10 with a built-in cooling system. The embossing roller, which is arranged opposite a take-off roller 12 for the pile fabric, works on the pile of the pile fabric 5 as long as it remains hot. The embossing roller 10 is provided internally with a cooling system (not shown).

The heating plate is heated to and kept at the particular temperature required by means of a temperature control system (not shown). The temperature is adjusted in such a way that the thermoplastic fibres of the pile of the pile fabric are heated to a temperature at which they begin to undergo plastic deformation.

Behind the patterning unit consisting of the embossing roller 10 and the take-off roller 12, the printed and embossed pile fabric 5 travels over a guide roller 9 and is then wound into a roll or cut into required lengths (not shown).

Figure 2:
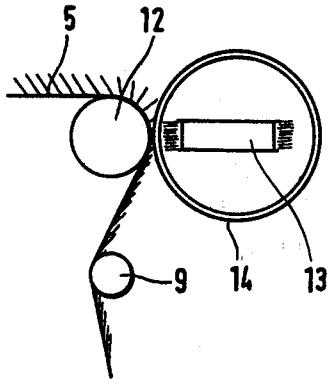
FIG. 2 is a diagrammatic side elevation of a modified patterning unit.

The difference between the embodiment illustrated in FIG. 2 and the embodiment illustrated in FIG. 1 is that, in FIG. 2, the patterning unit comprises a stencil drum 14 with a built-in turbulence beam 13 which is arranged opposite the take-off roller 12 instead of the embossing roller.

Figure 3:
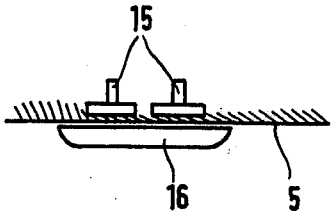
FIG. 3 shows another modified embodiment of a patterning unit.

The difference between the embodiment illustrated in FIG. 3 and the embodiments illustrated in FIGS. 1 and 2 is that, according to FIG. 3, the patterning unit consists of a fixed supporting surface 16 over which the pile fabric 5 travels, and of pressure stamps 15 adjustable relative to the supporting surface 16.

The pile fabric whose pile is to be printed and patterned in the manner described can travel into the thermoprinting unit already coloured, for example by partial or full printing from the back of the fabric. The pile could also be unicoloured or ombre-dyed.

We claim:

1. A machine for printing pile fabrics containing thermoplastic fibres, comprising a. means conveying said pile fabric through a printing zone, b. a thermoprinting web containing sublimable dyes, and means for winding and guiding said web into contact with the pile of said pile fabric and the web away from said pile fabric after heating thereof, c. flat heating means, the lower surface of which engages said thermoprinting web for heating the thermoplastic fibres of the pile to a temperature at which they begin to undergo plastic deformation, d. guide means for supporting said pile fabric, said guide means being positioned below and spaced from said heating means, e. means for vertically adjusting said guide means toward or away from said heating means to adjustably compress the pile fabric between said guide means and said heating means to effect sublimation of the dyes into the heating thermoplastic fibres, and f. an embossing roller positioned beyond the printing area for embossing the printed pile fabric, and means for synchronizing the movement of said thermoprinting web and said embossing roller to permit coordination between the printed color and the embossed pattern on the pile fabric.

2. The machine according to claim 1, in which said guide means is provided with a screw threaded spindle for adjustment of said guide means relative to said heating means, said adjustment permitting said pile to be compressed 40 to 60% of its thickness before entering the space between said guide means and said heating means.

3. The machine according to claim 1, in which said embossing roller cooperates with a counter roller to form a nip through which the printed pile fabric passes.

4. The machine according to claim 3, in which said embossing roller is provided with a cooling system.

* * * * *